United States Patent [19]
Takase
[11] 4,452,212
[45] Jun. 5, 1984

[54] FUEL SUPPLY CONTROL SYSTEM FOR AN INTERNAL COMBUSTION ENGINE

[75] Inventor: Sadao Takase, Yokohama, Japan

[73] Assignee: Nissan Motor Co., Ltd., Yokohama, Japan

[21] Appl. No.: 342,249

[22] Filed: Jan. 25, 1982

[30] Foreign Application Priority Data

Jan. 26, 1981 [JP] Japan ..... 56-8952

[51] Int. Cl.³ ..... F02D 33/00
[52] U.S. Cl. ..... 123/493; 123/326
[58] Field of Search ..... 123/326, 493

[56] References Cited

U.S. PATENT DOCUMENTS 3,192,706 7/1965 Dolza ..... 60/294
4,250,853 2/1981 Harada et al. ..... 123/326
4,327,682 5/1982 Harada ..... 123/326
4,357,923 11/1982 Hideg ..... 123/480 X

*Primary Examiner*—Parshotam S. Lall
*Assistant Examiner*—W. R. Wolfe
*Attorney, Agent, or Firm*—Schwartz, Jeffery, Schwaab, Mack, Blumenthal & Koch

[57] ABSTRACT

A fuel supply control system for an internal combustion engine having a fuel supply cut-off function is equipped with means for increasing in amount, the fuel supply of fuel in response to resumption of the supply of fuel subsequent to the fuel cut-off operation, thereby compensating for a fuel delivery delay characteristic which otherwise would occur upon the resumption of the supply of fuel. The increase in fuel is determined in response to at least one of variables which affect the rate of evaporation of the fuel adhered to the inner wall of the intake manifold during the fuel cut-off operation.

6 Claims, 7 Drawing Figures

1
AIR FLOW METER
2
ROTATION SENSOR
3
THROTTLE POSITION SENSOR
11
MANIFOLD TEMPERATURE SENSOR
4
FUEL INJECTION AMOUNT DETERMINATION CIRCUIT
5
DECELERATION DETECTION CIRCUIT
12
AIR AMOUNT INTEGRATION CIRCUIT
6
FUEL CUT OFF CONTROL CIRCUIT
13
FUEL INCREMENT DETERMINATION CIRCUIT
8
FUEL INCREMENT CONTROL CIRCUIT
9
AMPLITY AND DRIVE CIRCUIT
10
FUEL INJECTION VALVE

FUEL SUPPLY CONTROL SYSTEM FOR AN INTERNAL COMBUSTION ENGINE

BACKGROUND OF THE INVENTION

1. Field of the Invention

The present invention relates to a fuel supply control system for an internal combustion engine, and more particularly to a fuel supply control system having a fuel supply cut-off function operable upon deceleration of the engine.

2. Description of the Prior Art

Electronically controlled fuel injection systems fall into either one of two categories; (a) a type employing a plurality of fuel injection valves respectively for each of cylinders, and (b) a type employing a single fuel injection valve which is located immediately downstream of the throttle valve, for example.

In the above system in order to improve fuel economy, it has been proposed to provide a fuel cut-off function which temporarily terminates the supply of fuel during periods when engine torque is not required, such as during deceleration. However, in the case of a single point injection system, this cut-off function has induced a problem that the walls of the induction passage or conduit between the injector and the cylinders become wet with fuel during normal operation and this fuel is substantially removed by the air passing therethrough during the fuel cut-off. Thus, upon resumption of fuel injection, a substantial amount of the fuel initially injected impinges on the now dry induction passage walls to re-wet same. Accordingly a substantial delay results between the resumption of injection and desired amount of fuel actually being delivered to the engine cylinders giving rise to poor air-fuel ratio control.

SUMMARY OF THE INVENTION

The present invention provides a fuel supply control system in which the amount of the fuel supply is temporarily increased after resumption of the supply of fuel subsequent to a fuel-cut off operation, to compensate for the delay of the fuel supply due to the required wetting of the walls of the intake manifold. The increment by which the fuel supply is increased after resumption of the fuel supply is controlled in accordance with a parameter which varies with the fuel cut off operation. A fuel increment control signal is produced on the basis of at least one of the duration of fuel cut off operation, the integrated value of air flow amount, and the engine manifold temperature.

This fuel increment control signal is transmitted into a fuel increment control circuit wherein the pulse width of a pulse signal for controlling the time duration in which the fuel injection valve is energized.

Therefore, an object of the invention is to improve the accuracy of fuel delivery upon the resumption of the supply of fuel subsequent to a fuel-cut off operation.

BRIEF DESCRIPTION OF THE DRAWINGS

The features and advantages of the fuel supply control system of the present invention will be more clearly appreciated from the following description taken in conjunction with the accompanying drawings in which like reference numerals designate corresponding elements, and in which.

DETAILED DESCRIPTION OF THE PREFERRED EMBODIMENTS

Figure 1:
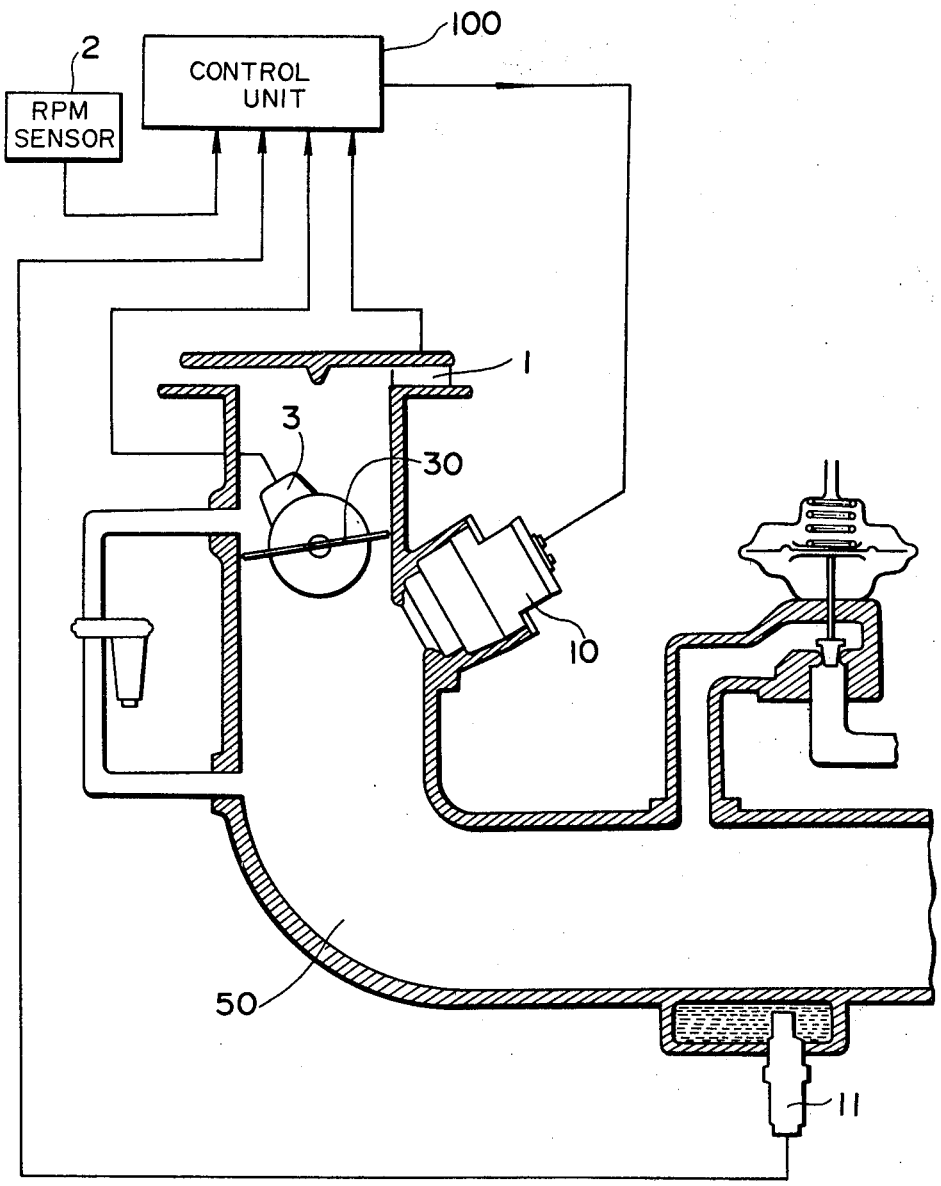
FIG. 1 is a cross sectional view of the air induction system for an internal combustion engine in which the fuel supply control system according to the present invention is utilized.

Reference is first made to FIG. 1, wherein an example of an air induction system for an internal combustion engine to which fuel supply control system according to the present invention is utilized, is shown. A fuel injection valve generally designated by 10 is positioned immediately downstream of a throttle valve 30. The fuel injection valve 10 receives a pressurized liquid fuel and discharges the same into an intake manifold generally designated by 50 in accordance with a drive signal from a control unit generally designated by 100. In order to appropriately determine the fuel injection valve opening time, the control unit 100 produces a fuel injection control signal in accordance with various engine perameters such as a throttle opening signal $S_1$ from a throttle position sensor 3 for sensing the rotation of the throttle plate 30, an engine rotation signal from an engine RPM sensor 2, an air amount signal Q from an air flow meter 1 provided at an inlet portion of the air induction system, a manifold temperature signal from a temperature sensor 11 disposed within a heater water chamber provided at a downstream portion of the intake manifold 50.

The fuel supply amount is thus determined in accordance with various engine parameters by the control unit 100 whose construction will become understood in conjunction with the following description of the preferred embodiments of the fuel supply control system according to the present invention.

A first embodiment of the present invention is explained hereinafter with reference to FIGS. 2 to 5.

Figure 2:
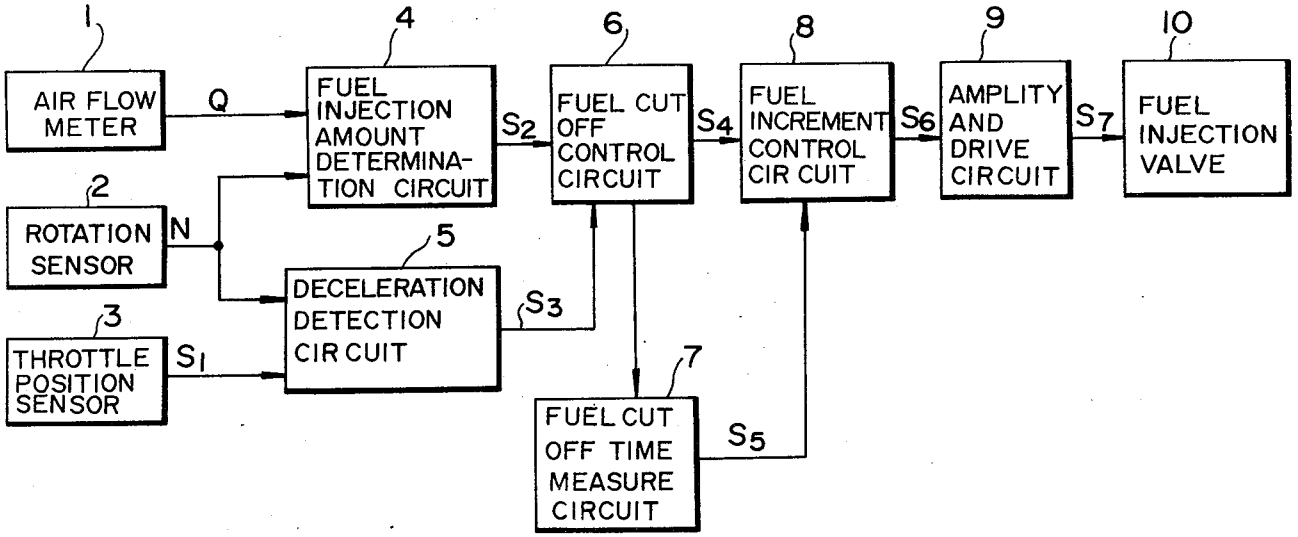
FIG. 2 is a general block diagram of a first embodiment of the fuel supply control system according to the present invention.

In FIG. 2 where the general construction of the first embodiment is illustrated, reference numeral 1 denotes an air flow meter such as a flapper type air flow meter disposed on the upstream of the intake manifold which produces the output signal Q proportional to the intake air amount. The reference numeral 2 indicates an engine RPM sensor comprising a crankshaft rotation sensor which produces an output signal N proportional to the engine crankshaft rotational speed.

The reference numeral 3 indicates the engine throttle position sensor which detects the opening degree of the throttle valve and produces an output signal $S_1$ proportional to the opening degree of the throttle valve.

The reference numeral 4 indicates the fuel injection amount determination circuit which calculates the amount of fuel to be supplied to the cylinder in accordance with the intake air amount from the air flow meter 1 and the engine speed signal from the engine RPM sensor 2 so that an air fuel mixture having a predetermined air fuel ratio near the stoichiometric value is produced.

The reference numeral 5 indicates a deceleration detecting circuit which determines that the engine is decelerating in response to the output signal N of the engine RPM sensor 2, and the output signal $S_1$ of the throttle position sensor 3.

The reference numeral 6 indicates the fuel cut off control circuit which receives the output signal $S_2$ of the fuel injection amount determination circuit 4, and the output signal $S_3$ of the deceleration detection circuit 5.

The reference numeral 7 indicates the fuel cut off time measuring circuit which measures the time duration in which the fuel is cut off and outputs the signal to a fuel increment control circuit 8.

The fuel increment control circuit 8 produces an output signal $S_6$ in accordance with the the output signal $S_4$ of the fuel cut off control circuit 6 and the output signal $S_5$ of the fuel cut off time measuring circuit, and transmits the same to an amplify and drive circuit 9. The amplify and drive circuit 9 amplify the output signal $S_6$ of the fuel increment control circuit 8 and produces a drive signal $S_7$ of the fuel injection valve 10.

The fuel cut off time measuring circuit 7 may preferably comprise an integration circuit which performs an integration operation during the time when the fuel supply is stopped. The integrated output signal proportional to the elapsed time is converted to a voltage signal. The voltage signal thus obtained is then input to a pulse width moduration circuit of the fuel increment control circuit 8, and a pulse width of the output pulse signal is increased by the amount corresponding to the time duration in which the fuel supply is stopped.

Figure 3:
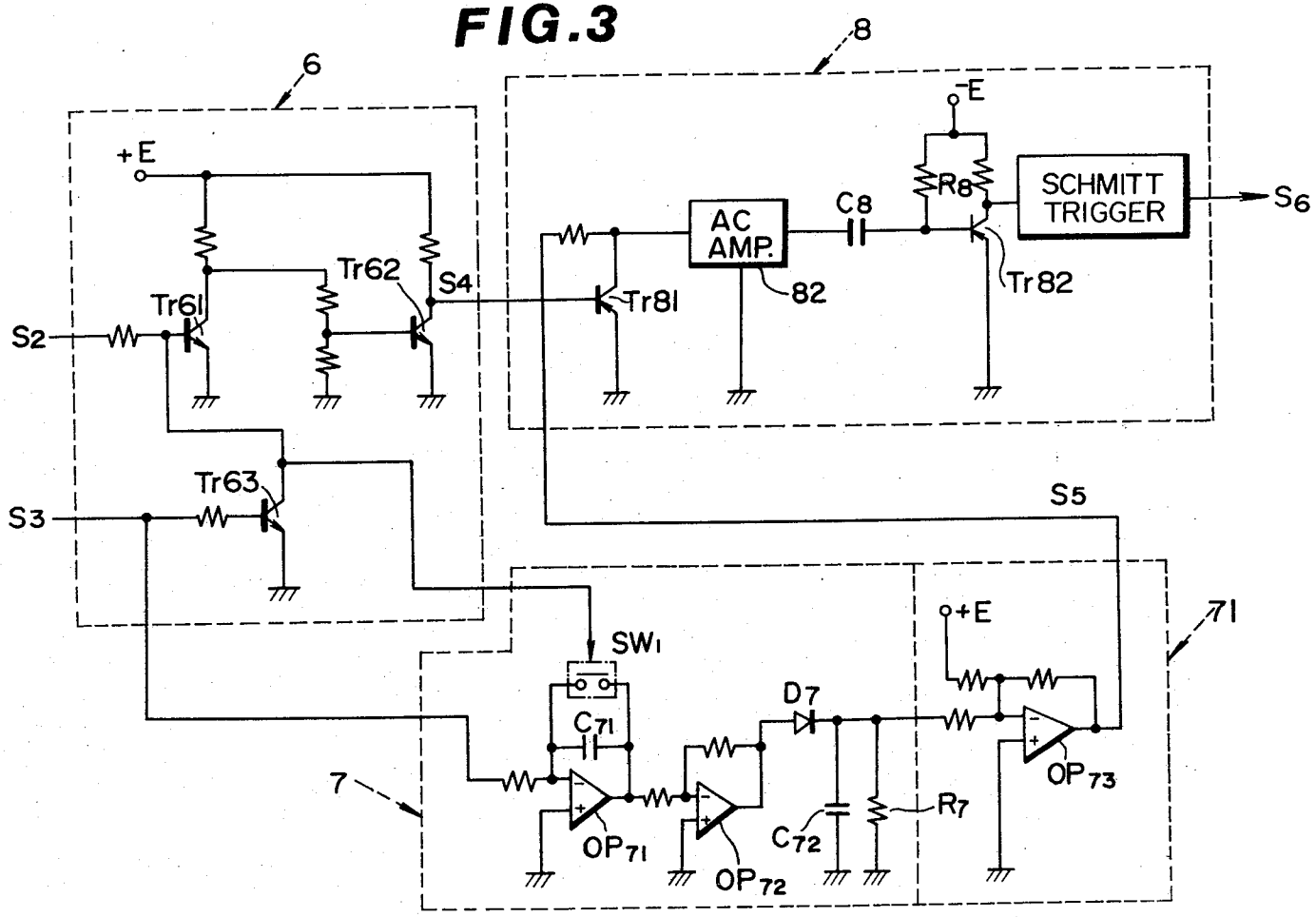
FIG. 3 is a more detailed circuit diagram of a fuel cut-off control circuit 6, a fuel cut-off time measuring circuit 7, and a fuel increment control circuit 8 of the first embodiment shown in FIG. 2.

Referring now to FIG. 3, the construction of the fuel cut off control circuit 6, fuel cut off duration measuring circuit 7, and the fuel increment control circuit is explained in detail hereinafter.

The fuel cut off control circuit 6 comprises a first to third transistors $Tr_{61}$ to $Tr_{63}$. Generally, the signal $S_2$ is inverted twice by the transistors $Tr_{61}$ and $Tr_{62}$. The signal $S_4$ is thus produced at the collector of the transistor $Tr_{62}$. When a high level deceleration signal $S_3$ is applied to the base thereof, the transistor $Tr_{63}$ turns conductive. Consequently, the base of the transistor $Tr_{61}$ is held at 0 V and this transistor $Tr_{61}$ turns off. The fuel supply control signal $S_2$ is thus cut-off by the deceleration signal $S_3$ applied to the base of the transistor $Tr_{63}$.

As shown, the fuel cut off duration measuring circuit 7 comprises a first and second operational amplifiers $OP_{71}$ and $OP_{72}$ which respectively operates as an integrator and an inverting amplifier. When a high level deceleration signal $S_3$ is applied to an inverting input of the first operational amplifier $OP_{71}$, it initiates the integrating operation at a predetermined integration ratio. This integrator i.e., the operational amplifier $OP_{71}$ is reset by the closure of a switching means SW1 connected in parallel to the integration capacitor $C_{71}$, which turns on by a high level collector voltage of the transistor $Tr_{63}$ of the fuel cut off control circuit 6. The integrated voltage produced at the output terminal of the operational amplifier $OP_{71}$ is then applied to the operational amplifier $OP_{72}$ and inverted therein. The output signal of the operational amplifier $OP_{72}$ is applied to a capacitor $C_{72}$ via a diode $D_7$ and the discharge rate of the capacitor $C_{72}$ is determined by time constant defined by the capacitance of the capacitor $C_{72}$ and the resistance of the resistor $R_7$. The duration of the fuel increment is controlled in accordance with the voltage level of the capacitor $C_{72}$.

The circuit designated by reference numeral 71 which is incorporated in the block 7 in FIG. 2 includes an operational amplifier $OP_{73}$ which forms a voltage summing circuit for producing a fuel cut off duration signal $S_5$ by summing the voltage level of the capacitor $C_7$ and a predetermined voltage from a voltage source connected to an inverting input of the operational amplifier.

The fuel increment control circuit 8 comprises a pulse width moduration circuit including a transistor $Tr_{81}$, an AC amplifier 82, a capacitor $C_8$, a transistor $Tr_{82}$ connected to a negative voltage source $-E$, and a Schmitt trigger circuit 83. In this fuel increment control circuit 8, the pulse width of the fuel injection control signal $S_4$ is modulated basically in accordance with the charging and discharging caracteristic of the capacitor $C_8$. The operation of the fuel increment control circuit 8 is explained with reference to FIG. 4.

Figure 4:
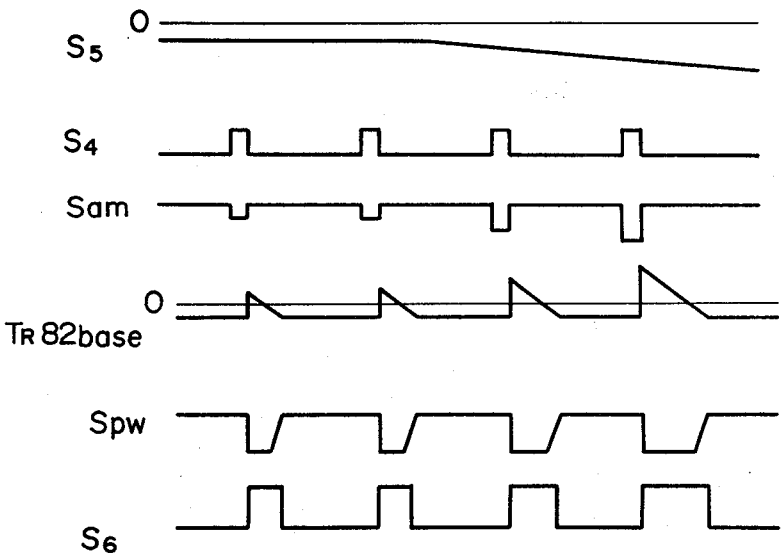
FIG. 4 is a timing chart showing the wave forms of the base voltage of the transistor $Tr_{82}$ as well as the signals S4 to S6 shown in FIG. 3.

As shown in FIG. 4, the fuel supply control pulse signal $S_4$ which is applied to the base of the transistor $Tr_{81}$ is amplitude modulated by the fuel cut off duration signal $S_5$ applied at the collector thereof, forming an amplitude modulated pulse signal $S_{am}$. The signal $S_{am}$ is amplified by an AC amplifier 82 where the DC component of the signal $S_{am}$ is rejected and the amplified signal is applied to a terminal of the capacitor $C_8$.

At each leading edge of the pulse signal $S_{am}$, the capacitor $C_8$ is rapidly charged by a current from the transistor $Tr_{82}$, since the transistor $Tr_{82}$ is sufficiently forward biased by the negative voltage applied to the base thereof. It is to be noted that the charging voltage of the capacitor $C_8$ is proportional to the amplitude of the pulse signal $S_{am}$, i.e., the amplitude of the fuel cut off duration signal $S_5$.

At each trailing edge of the pulse signal $S_{am}$, the base of the transistor $Tr_{82}$ is supplied with a positive voltage produced at the terminal of the capacitor $C_8$ and the transistor $Tr_{82}$ immediately turns off. The base voltage of the transistor $Tr_{82}$ is then gradually decreased in accordance with the discharge of the electric energy stored in the capacitor $C_8$ through the resistor $R_8$, thus forming a saw tooth wave as shown in FIG. 4. When the base voltage of the transistor $Tr_{82}$ is reduced to the initial negative level, the transistor $Tr_{82}$ turns on again. In accordance with this on and off operation of the transistor $Tr_{82}$, an output signal $S_{pw}$ in the form of a generally rectangular pulse is produced at the collector of the transistor $Tr_{82}$. The waveform of the signal $S_{pw}$ is then shaped by the Schmitt trigger circuit 82 to form the signal $S_6$.

Figure 5:
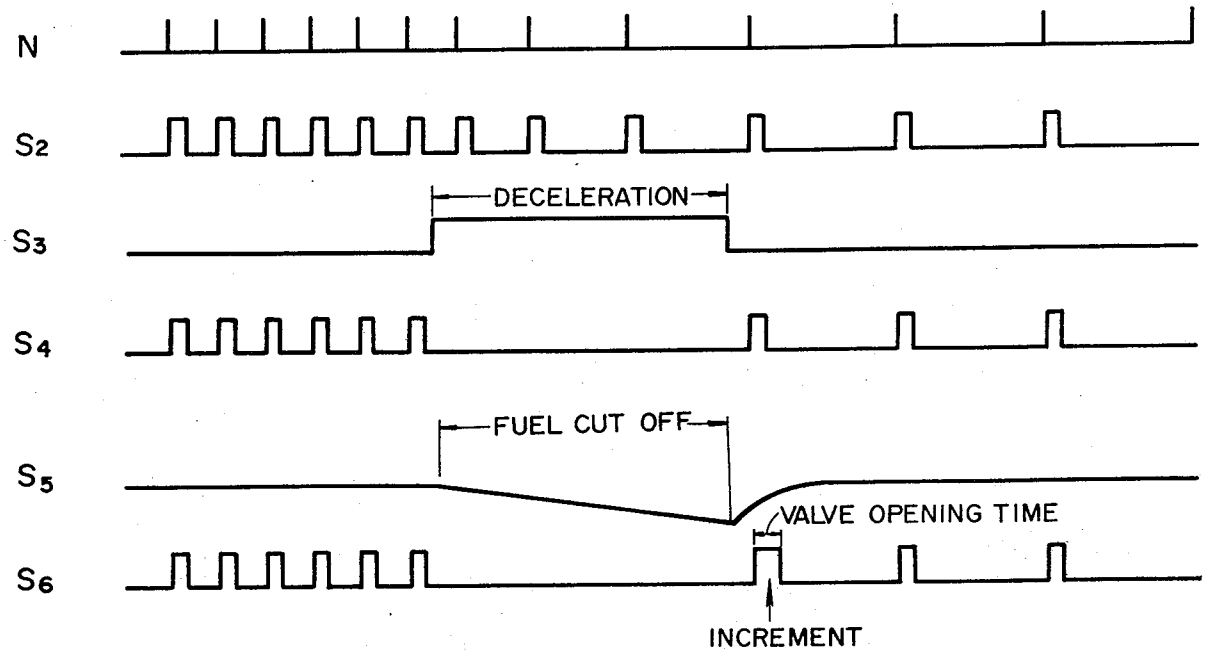
FIG. 5 is a timing chart showing mutual timing relation of various signals shown in FIG. 2.

Referring to FIG. 5, the operation of this first embodiment of the fuel supply control system is explained.

Generally, the fuel supply amount is determined on the basis of the introduced air amount Q in order to maintain the stoichometric air/fuel ratio.

In addition, in the case of the fuel injection system, the fuel supply amount is determined in accordance with the valve opening time and frequency. If the timing of valve opening is synchronized with the engine rotation, the fuel supply amount is derived by the following equation:

$$P=Q/N$$

where Q indicates the introduced air amount detected by the air flow meter 1, N is the engine rotation detected by the engine RPM sensor 2, and P is the fuel injection valve opening duration.

The opening duration of the fuel injection valve is determined in accordance with various engine parameters such as the engine coolant temperature, intake air temperature, and a sensed value of the air fuel ratio of the mixture in the fuel injection amount determination circuit.

An output signal $S_2$ synchronized with the engine rotation, thus produced in the fuel injection amount determination circuit is transmitted to the fuel supply control circuit 6. The deceleration detecting circuit 5 determines the deceleration condition of the engine on the basis of the engine rotation signal N from the engine RPM sensor 2 and the throttle opening signal $S_1$ from the throttle position sensor 3.

That is to say, when the throttle opening degree of is smaller than the predetermined level and the engine speed is higher than a predetermined level, the deceleration detection circuit determines that the engine is decelerating.

When the deceleration of engine is detected, the deceleration signal $S_3$ is transmitted to the fuel supply control circuit 6. The fuel supply stop control circuit 6 interrupts the fuel injection signal $S_2$ of the fuel supply amount control circuit 4 whenever the deceleration signal $S_3$ from the deceleration detection circuit 5 is present.

The fuel cut off time measuring circuit 7 measures the time duration when the fuel injection signal $S_2$ is interrupted by the fuel cut-off control circuit 6, and transmitts the cut-off duration signal $S_5$ to the fuel increment control circuit 8.

The fuel increment control circuit 8 adjusts the fuel supply by an increased amount in accordance with the output signal $S_5$ of the fuel cut off time measuring circuit 7 for a predetermined time duration after fuel injection is reestablished subsequent to the fuel cut-off operation.

That is to say, the fuel increment control circuit 8 produces the pulse signal $S_6$ having fuel pulses of increased pulse width in comparison with the fuel supply control signal $S_2$. This pulse signal $S_6$ is transmitted to the amplify and drive circuit 9. The amplify and drive circuit 9 then produces the drive signal $S_7$ by amplifying the signal $S_6$ and drives the fuel injection valve 10.

It will be appreciated from the foregoing, according to the above explained circuit construction, the fuel increment operation after the resumption of fuel injection is effected to eliminate the poor air/fuel ratio control due to the vaporization of the liquid fuel on the wall of the manifold during the period of fuel supply cut-off.

In the other words, the amount of fuel vaporized from the manifold wall is estimated as a function of the temperature within the manifold, the amount of air passing through the manifold and the fuel cut off time duration.

Although the present invention has been explained above by way of an example in which the adjustment is based on the fuel cut-off duration, the increasing amount of the fuel supply may be determined in accordance with a fuel increasing ratio signal produced on the basis the intake air temperature and the air flow amount.

Figure 6:
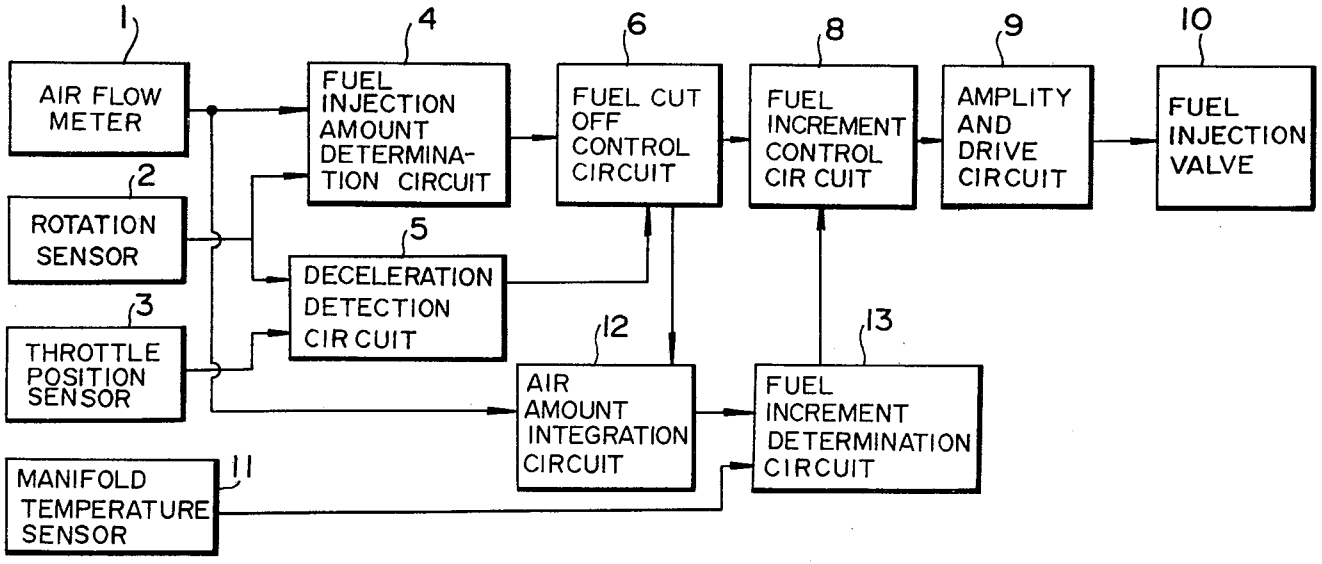
FIG. 6 is general block diagram of a second embodiment of the fuel supply control system according to the present invention.

Reference is now made to FIG. 6, wherein a second embodiment according to the present invention is explained.

In FIG. 6, the reference numerals 1 to 10 indicate the corresponding circuit elements shown in FIG. 1, and the explanation thereof is omitted. This embodiment features the provision of the manifold temperature sensor 11 and the air flow amount integration circuit 12 and the fuel increment rate determination circuit 13.

The manifold temperature sensor 11 comprises a temperature sensor which is mounted on the intake manifold, such as a thermister type temperature sensor having temperature dependent resistance characteristic.

The air flow amount integration circuit 12 comprises an integrator which integrates the output voltage from the air flow amount detector whenever fuel cut-off operation is effected, and produces an output signal corresponding to the integrated amount of the intake air introduced during fuel cut-off operation.

The fuel increment rate determination circuit 13 comprises an adder which adds a voltage signal derived from the variation of resistance of the manifold temperature sensor 11, to the voltage signal corresponding to the integrated value of the air amount integration circuit 12 and produces a fuel increasing control signal (voltage signal) on the basis of the air amount integration signal and the intake manifold temperature.

In this case, the manifold temperature signal and the fuel amount integration signal may be used either individually or in a combined manner.

Figure 7:
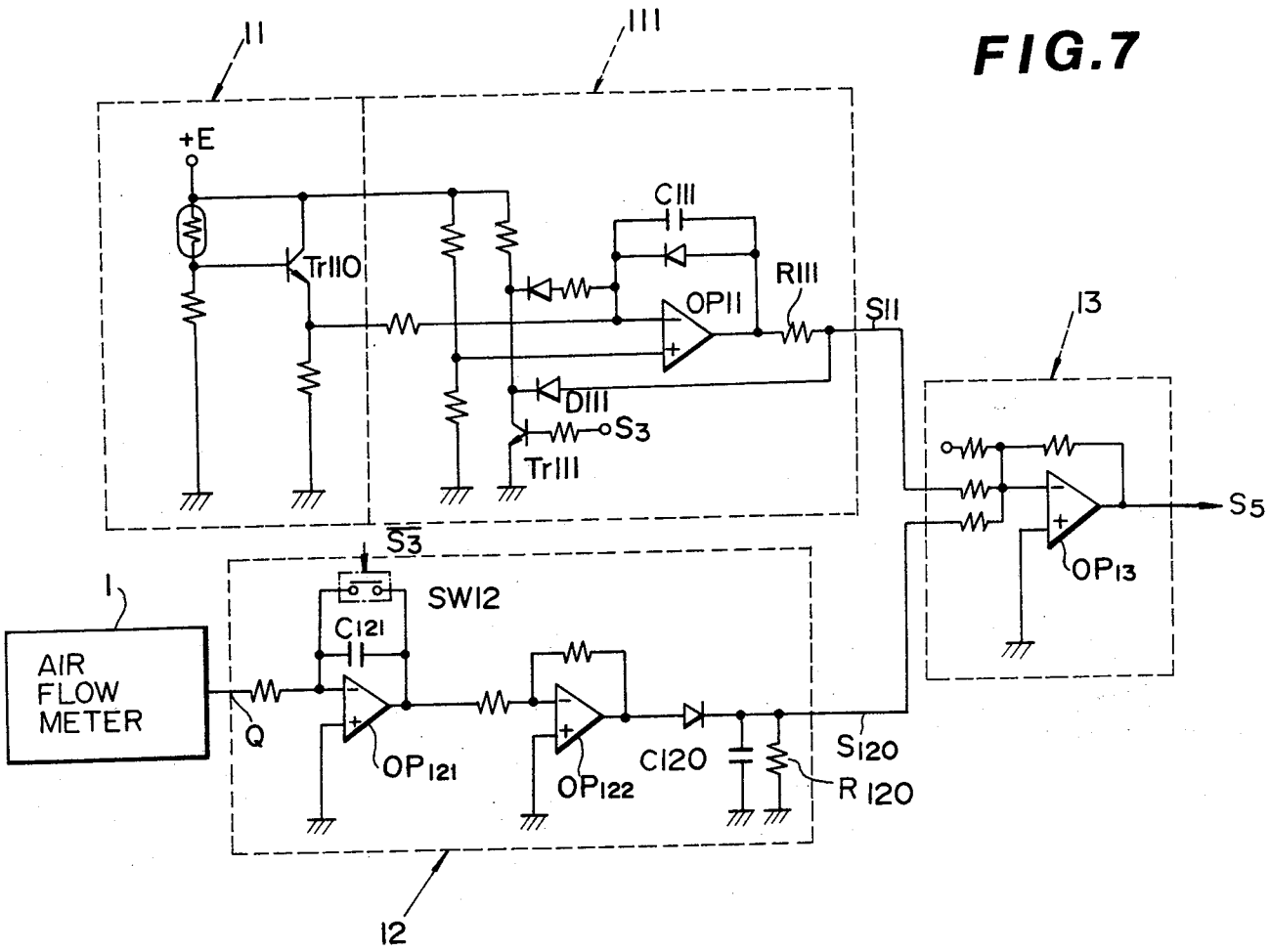
FIG. 7 is a more detailed circuit diagram of a manifold temperature sensor 11, an air amount integraion circuit 12, and a fuel increment rate determination circuit 13 of the second embodiment of the fuel supply control system shown in FIG. 6.

The construction of the circuits 11 to 13 are described in detail with reference to FIG. 7 hereinafter.

As shown, the output signal of the manifold temperature sensor 11 is applied to the increment signal generation circuit 111 which is incorporated in the block 13 in FIG. 6. The increment signal generating circuit 111 comprises a transitor $Tr_{111}$ which receives the deceleration signal $S_3$ at the base thereof, and an operational amplifier $OP_{11}$ having a variable amplification factor.

The output signal $S_{11}$ of the increment signal generation circuit 111 is supplied to an inverting input of an operational amplifier $OP_{13}$ of the fuel increment rate determination circuit 13.

When the high level deceleration signal $S_3$ is applied to the base of the transitor $Tr_{111}$, it turns on to reduce the voltage level of an inverting input of the operational amplifier $OP_{11}$ to the emitter level of a transistor $Tr_{110}$ incorporated in the intake manifold temperature sensor 11.

In accordance with this change in the voltage level of the inveting input of the operational amplifier $OP_{11}$, a capacitor $C_{111}$ connected between this inverting input and the output thereof is charged by the emitter voltage of the transistor $Tr_{110}$ which is proportional to the intake manifold temperature level.

In this state, however, the output voltage of the operational amplifier $OP_{11}$ is not transmitted to the fuel increment rate determination circuit 13 since the resistor $R_{111}$ connected to the output terminal of the operational amplifier $OP_{11}$ is grounded via a diode $D_{111}$ and the transistor $Tr_{111}$.

When the deceleration signal $S_3$ disappears, the transistor $Tr_{111}$ turns off to produce an output signal $S_{11}$ at the terminal of the resistor $R_{111}$. Thereupon, the output voltage of the operational amplifier $OP_{11}$ is gradually decreased in accordance with the discharge of the capacitor $C_{111}$. Thus, the fuel increment ratio is gradually decreased in accordance with the output signal $S_{11}$ of the increment signal generation circuit 111.

Turning to the air amount integration circuit 12, it comprises a first and second operational amplifiers $OP_{121}$ and $OP_{122}$ respectively acting as an integrator and an inverting amplifier. The operational amplifier $OP_{121}$ has a capacitor $C_{121}$ connected between the inverting inut and the output thereof and receives the output singal Q from the air flow meter 1. A swiching means $SW_2$ responsive to an inverted signal $S_3$ of the deceleration signal $S_3$ is also connected in parallel to the capacitor $C_{121}$ and integration is initiated at the leading edge of the deceleration signal $S_3$. The output signal of the operational amplifier $OP_{121}$, corresponding to the integrated value of the air flow amount during deceleration of the engine, is then inverted by the operational amplifier $OP_{122}$ and applied to the capacitor $C_{120}$. When the deceleration signal $S_3$ disappears, the electric charge stored in the capacitor $C_{120}$ is discharged in accordance with the time constant defined by the capacitance of the capacitor $C_{120}$ and the resistance of a resistor $R_{120}$ connected in parallel thereto.

The output signal $S_{12}$ of the air amount integration circuit 12 is also applied to the inverting input of the operational amplifier 13 and summed up with the output signal $S_{11}$ of the increment signal generation circuit 111.

The output signal $S_5$ of the fuel increment rate determination circuit 13 is then applied to the fuel increment control circuit 8, where the pulse width of the fuel injection control signal $S_2$ is controlled in accordance with the signal $S_5$ in a similiar manner as in the previous embodiment.

In this way, when the signal $S_5$ in the form of the voltage signal is applied to the fuel increment control circuit 8, the pulse width of the fuel injection control signal $S_2$ is modulated by the input signal, i.e., the signal $S_5$.

Furthermore, the invention is readily adopted to the fuel metering devices including conventional carburetor system.

In caburator systems, there is a type which is equipped with an electric system for controlling the fuel supply amount, including the fuel cut-off function, such as a system including electromagnetic valves which control the air flow and the fuel amount.

Such carburetor systems, however have also suffered from the above mentioned problems.

In the case of such caburetor systems, therefore, the engine operational performance and emission characteristics are improved by the enrichment of the fuel supply amount (reducing the air amount passing through the air bleed) subsequent to the fuel cut-off control.

In addition, similar to the previous embodiment, the time duration, during which the fuel supply amount is increased, may be varied in accordance with the fuel cut-off time duration, in combination with the integrated air amount aspirated during fuel cut-off operation, or the intake manifold temperature.

Furthermore, adjustment of the fuel supply amount may be effected such that the amount of the adjustment is gradually decreased.

It will be appreciated from the foregoing, that according to the present invention, the amount of fuel supplied after the resumption of the fuel supply subsequent to the fuel cut off operation, is determined in accordance with the time duration of the fuel-cut off operation, integrated amount of the air passing into the engine during the fuel cut off operation, or the intake manifold temperature. Thus, the engine operating performance and the emission characteristic is greatly improved by an appropriate air-fuel ratio control.

What is claimed is:

1. A fuel supply control system for an internal combustion engine having a cylinder and an intake manifold connected to said cylinder for admitting air to same, comprising:

fuel supply means for supplying fuel to the air admitted to said cylinder via the intake manifold;

fuel cut-off operation control means for causing said fuel supply means to suspend the supplying of fuel during operation of the engine;

fuel increment control means for causing said fuel supply means to increase, in amount, the supply of fuel in response to a resumption of the supply of fuel subsequent to the suspension of the supply of fuel;

temperature sensor means for generating a temperature signal indication of the temperature of the intake manifold;

an air flow meter associated with the intake manifold;

an air amount integration means coupled with said air flow meter for generating an integrated signal indicative of an amount of air admitted to said cylinder via the intake manifold;

wherein said fuel increment control means is operative for controlling the supply of fuel in response to said temperature signal and integrated signal.

2. A fuel supply control system for an internal combustion engine having an air induction system including a throttle valve and an intake manifold, comprising:

an air flow meter means, disposed in the air induction system, for generating an air flow rate signal indicative of the rate of air flow via the air induction system;

an engine RPM sensor means for generating a rotational speed signal indicative of the rotational speed of the engine;

a throttle position sensor means for generating a throttle position signal indicative of the angular position of the throttle valve;

control means for generating a fuel supply control signal in response to said air flow rate signal and said rotational speed signal;

an electrically controlled fuel supply means for supplying fuel into the air induction system in response to said fuel supply control signal;

determination means for determining an engine deceleration condition in response to said rotational speed signal and said throttle position signal and generating a deceleration signal indicative of the engine deceleration condition;

fuel cut-off operation control means for suspending operation of said fuel supply means in response to said deceleration signal;

means for generating a signal indicative of evaporation of fuel adhered to the inner wall of the air induction system; and fuel increment control means for modulating said fuel supply control signal during a predetermined period after resumption of the supply of fuel subsequent to said fuel cut-off operation to cause said fuel supply means to increase the supply of fuel in response to said fuel evaporation indicative signal;

wherein said fuel supply control signal is a pulse train, synchronized with said rotational speed signal, and the fuel supply means is operable to be energized by each pulse of said pulse train, and wherein said fuel increment control means includes an integration circuit for producing a voltage signal by integrating said deceleration signal each time said deceleration signal is produced, and a pulse width modulation circuit for modulating the pulse width of each pulse of said pulse train in accordance with said voltage signal.

3. A fuel supply control system for an internal combustion engine having an air induction system including a throttle valve and an intake manifold, comprising:

an air flow meter means, disposed in the air induction system, for generating an air flow rate signal indicative of the rate of air flow via the induction system;

an engine RPM sensor means for generating a rotational speed signal indicative of the rotational speed of the engine;

a throttle position sensor means for generating a throttle position signal indicative of the angular position of the throttle valve;

control means for generating a fuel supply control signal in response to said air flow rate signal and said rotational speed signal;

an electrically controlled fuel supply means for supplying fuel into the air induction system in response to said fuel supply control signal;

determination means for determining an engine deceleration condition in response to said rotational speed signal and said throttle position signal and generating a deceleration signal indicative of the engine deceleration condition;

fuel cut-off operation control means for suspending operation of said fuel supply means in response to said deceleration signal;

means for generating a signal indicative of evaporation of fuel adhered to the inner wall of the air induction system;

fuel increment control means for modulating said fuel supply control signal during a predetermined period after resumption of the supply of fuel subsequent to said fuel cut-off operation to cause said fuel supply means to increase the supply of fuel in response to said fuel evaporation indicative signal;

wherein said fuel supply control signal is a pulse train synchronized with said rotational speed signal, and the fuel supply means is operable to be energized by each pulse of said pulse train, and wherein said fuel increment control means includes an intake manifold temperature sensor for producing a first voltage signal indicative of the intake manifold temperature, and an air amount integration circuit for producing a second voltage signal by integrating said air flow rate signal when said deceleration signal is present, a summing circuit for producing a third voltage signal by summing said first and second voltage signals, and a pulse width modulation circuit for modulating the pulse width of each pulse of said pulse train in accordance with said third voltage signal.

4. A fuel supply control system for an internal combustion engine having an air induction system including a throttle valve and an intake manifold, comprising:

an air flow meter means, disposed in the air induction system, for generating an air flow rate signal indicative of the rate of air flow via the air induction system;

an engine RPM sensor means for generating a rotational speed signal indicative of the rotational speed of the engine;

a throttle position sensor means for generating a throttle position signal indicative of the angular position of the throttle valve;

control means for generating a fuel supply control signal in response to said air flow rate signal and said rotational speed signal;

an electrically controlled fuel supply means for supplying fuel into the air induction system in response to said fuel supply control signal;

determination means for determining an engine deceleration condition in response to said rotational speed signal and said throttle position signal and generating a deceleration signal indicative of the engine deceleration condition;

fuel cut-off operation control means for suspending operation of said fuel supply means in response to said deceleration signal;

means for generating a signal indicative of evaporation of fuel adhered to an inner wall of the air induction system; and fuel increment control means for modulating said fuel supply control signal during a predetermined period after resumption of the supply of fuel subsequent to said suspending of said fuel supply means operation to cause said fuel supply means to increase the supply of fuel in response to said fuel evaporation indicative signal;

said evaporation indicative signal means further comprising:

temperature sensor means for generating a temperature signal indicative of the temperature of the intake manifold; and an air amount integration means coupled to said air flow meter means for generating an integrated signal indicative of an amount of air admitted via the air induction system to the engine; and means responsive to said temperature signal and said integrated signal for generating said evaporation indicative signal.

5. A fuel supply control system as claimed in claim 4, wherein said evaporation indicative signal generating means includes fuel cut-off time measure means for generating a fuel cut-off time signal indicative of the duration of the suspension of the supply of fuel.

6. A fuel supply control system as claimed in claim 4, wherein said determination means determines that the engine is decelerating when the engine speed is above a predetermined level and the throttle valve is substantially closed.

* * * * *